US009188011B2

(12) United States Patent
Khanin

(10) Patent No.: US 9,188,011 B2
(45) Date of Patent: Nov. 17, 2015

(54) BLADE FOR A GAS TURBINE, METHOD FOR MANUFACTURING A TURBINE BLADE, AND GAS TURBINE WITH A BLADE

(75) Inventor: Alexander Anatolievich Khanin, Moscow (RU)

(73) Assignee: ALSTOM TECHNOLOGY LTD., Baden (CH)

( * ) Notice: Subject to any disclaimer, the term of this patent is extended or adjusted under 35 U.S.C. 154(b) by 906 days.

(21) Appl. No.: 13/306,050

(22) Filed: Nov. 29, 2011

(65) Prior Publication Data

US 2012/0134845 A1 May 31, 2012

(30) Foreign Application Priority Data

Nov. 29, 2010 (RU) ..... 2010148723

(51) Int. Cl.
*F01D 5/18* (2006.01)
*F01D 5/08* (2006.01)

(52) U.S. Cl.
CPC ..... *F01D 5/187* (2013.01); *F01D 5/081* (2013.01); *F05D 2230/21* (2013.01); *Y10T 29/49343* (2015.01)

(58) Field of Classification Search
CPC ..... F01D 5/081; F01D 5/187
USPC ..... 415/115; 416/95, 96 A, 96 R, 97 R
See application file for complete search history.

(56) References Cited

U.S. PATENT DOCUMENTS 3,142,875 A * 8/1964 Lirones et al. ..... 164/32
3,715,170 A * 2/1973 Savage et al. ..... 416/97 R
3,834,831 A * 9/1974 Mitchell ..... 416/95
3,834,931 A 9/1974 Mitchell
3,867,068 A * 2/1975 Corsmeier et al. ..... 416/97 R
4,047,837 A * 9/1977 Hueber et al. ..... 416/95
5,498,132 A 3/1996 Carozza et al.

(Continued)

FOREIGN PATENT DOCUMENTS

EP 1 806 426 A1 1/2006
EP 1832712 A1 9/2007

(Continued)

OTHER PUBLICATIONS

Extended Search Report issued Feb. 2, 2014 by the European Patent Office, in corresponding European Patent Application No. 11190898.4. (6 pages).

(Continued)

*Primary Examiner* — Nathaniel Wiehe
*Assistant Examiner* — Woody A Lee, Jr.
(74) *Attorney, Agent, or Firm* — Buchanan Ingersoll & Rooney PC

(57) ABSTRACT

A blade (30') for a gas turbine has an airfoil (31) and a blade root (32) for mounting the blade (30) on a rotor shaft of the gas turbine. The airfoil (31) is provided with cooling channels (33, 35) in the interior thereof, which cooling channels (33, 35) preferably extend along the longitudinal direction and can be supplied with cooling air (45) through cooling air supply passages (40-43) within the blade root (32). The blade root (32) includes a blade channel (40) running transversely through the blade root (32) and is connected to the cooling channels (33, 35), and an insert (41) is inserted into the blade channel (40) for determining the final configuration and characteristics of the connections between the blade channel (40) and the cooling channels (33, 35).

9 Claims, 4 Drawing Sheets

(56) References Cited

U.S. PATENT DOCUMENTS

| | | | | |
|---|---|---|---|---|
| 8,827,647 | B1 * | 9/2014 | Liang | 416/97 R |
| 2007/0041836 | A1 * | 2/2007 | Tschuor et al. | 416/97 R |
| 2007/0274831 | A1 | 11/2007 | Beck et al. | |

FOREIGN PATENT DOCUMENTS

| | | | |
|---|---|---|---|
| FR | 2638206 | A1 | 4/1990 |
| GB | 2 051 256 | A | 1/1981 |
| GB | 2 319 308 | A | 5/1998 |
| SU | 245 497 | | 9/1972 |
| SU | 754 094 | A1 | 8/1980 |
| WO | 99/47792 | A1 | 9/1999 |

OTHER PUBLICATIONS

English translation of Decision of Grant issued Oct. 2, 2014 by the Russian Patent Office in corresponding Russian Application No. 2010148723, and an English translation thereof.

Search Report issued Apr. 19, 2011 by the European Patent Office in Swiss Application No. 20372010.

* cited by examiner

BLADE FOR A GAS TURBINE, METHOD FOR MANUFACTURING A TURBINE BLADE, AND GAS TURBINE WITH A BLADE

This application claims priority under 35 U.S.C. 119 to Russian Federation application no. 2010148723, filed 29 Nov. 2010, the entirety of which is incorporated by reference herein.

BACKGROUND

1. Field of Endeavor

The present invention relates to gas turbines, and more specifically a blade for a gas turbine.

Especially, the invention relates to designing rotor blades of an axial-flow turbine used in a gas turbine unit. The turbine rotor includes a rotating shaft with axial fir-tree type slots where several blade rows and several rotor heat shields are installed alternately one after another.

2. Brief Description of the Related Art

The schematized section of a gas turbine stage is shown in FIG. 1. The turbine 10 of FIG. 1 includes a stator 12 and a rotor 11. The stator 12 represents a housing and includes a vane carrier 15 with stator heat shields S1-S3 and vanes V1-V3 mounted therein. The stator 12 concentrically surrounds the rotor 11 and defines a hot gas path 13. Hot gas 16 generated in a combustion chamber (not shown) passes through profiled channels between the vanes V1-V3, hits against blades B1-B3 mounted in shaft slots of a rotor shaft 14, and thus makes the turbine rotor 11 rotate.

Inner platforms 23 of the 1st, 2nd and 3rd stage blades B1, B2 and B3, in combination with intermediate rotor heat shields R1, R2, form the inner outline of the turbine flow or hot gas path 13, which separates the cavity of rotor cooling air transit (cooling air 17) from the hot gas flow 16. To improve tightness of the cooling air flow path between adjacent blades in the circumferential direction, sealing plates 29 are installed. When cooling the rotor shaft 14, cooling air 17 in this design flows in the axial direction along a common flow path between blade roots 24 and rotor heat shields R1, R2 and enters in turn into the internal cavity (cooling channels) of the blade B1, then into that of the blade B2 and that of blade B3 (cooling air 18).

Turbine blades used in present day efficient gas turbine units are operated under high temperatures with minimum possible air supply. Striving towards cooling air saving results in complication of internal blade channel configurations. Therefore, the blade manufacturing process is very complicated. After blade casting, a problem frequently occurs in elimination (etching out) of a ceramic (casting) core from the blade internal cavity (cooling channels).

FIGS. 2 and 3 show the external configuration and internal channel geometry, respectively, of a typical gas turbine blade according to the state of the art. The blade 19 includes an airfoil 20 with a leading edge 21 and trailing edge 22, and a blade root 24 with an inlet 25 for supplying the internal cooling channel structure (FIG. 3) with cooling air. Blade root 24 and airfoil 20 are separated by a platform 23. The internal cooling channel structure includes a plurality of cooling channels 20 and 27*a-c*, which extend in the longitudinal direction of the blade 19. Usually, some parallel cooling channels 27*a-c* are connected in series to build one meandering channel, as is shown in FIG. 3. Such a meandering channel 27*a-c* results in a blind tube or dead end zone 28, which rules out any possibility that a liquid flow-through could be established to remove (by wet etching) ceramic core rests from there; this fact makes the manufacturing process more expensive and sets up a danger concerning the presence of detrimental remains of the core in internal blade channels.

If the blade cooling scheme of the gas turbine blade in question cannot be simplified without generating significant cooling air losses, then a technological possibility for a guaranteed and complete removal of the ceramic core from the internal blade cavity should be provided.

SUMMARY

One of numerous aspects of the present invention includes a blade for a gas turbine which can avoid the disadvantages of the known blades and allows realizing complicated cooling channel geometries and optimized cooling air distribution and supply without sacrificing the simplicity of manufacturing of the blade.

Another aspect includes a method for manufacturing such a blade.

Yet another aspect includes a gas turbine with such blades.

Another aspect includes a blade which comprises an airfoil extending along a longitudinal direction, and a blade root for mounting said blade on a rotor shaft of said gas turbine, whereby said airfoil of said blade is provided with cooling channels in the interior thereof, which cooling channels preferably extend along the longitudinal direction and can be supplied with cooling air through cooling air supply means arranged within said blade root.

The blade root is provided with a blade channel running transversely through said blade root and being connected to said cooling channels, and an insert is inserted into said blade channel for determining the final configuration and characteristics of the connections between said blade channel and said cooling channels.

A blade design with an insert and connecting means in it allows cooling air leaks to be reduced, blade reliability and life time to be increased, and turbine efficiency to be improved.

According to an embodiment, the blade channel is a cylindrical channel, and the insert is of a tubular configuration such that it fits exactly into said cylindrical channel.

Especially, the insert has at least one nozzle in its wall, through which one of said cooling channels is connected to said blade channel, and which determines the mass flow of cooling air entering said one cooling channel.

According to another embodiment, adjacent cooling channels are separated by a wall but connected via the blade channel, and the insert is configured to close the connection between the adjacent cooling channels.

According to another embodiment, cooling air is supplied to the insert at one end.

According to another embodiment, cooling air exits the insert at the other end.

Especially, the cooling air exits the insert at the other end through a nozzle.

According to another embodiment, the insert is closed at the other end, especially by means of a plug.

According to another embodiment, the insert is brazed to the blade.

Yet another aspect includes a method for manufacturing a blade embodying principles of the present invention, in a first step of which the blade is formed by a casting process, whereby a core is used to form said cooling channels within the airfoil of said blade, in a second step said blade channel is machined into the blade root of said blade, in a third step said core is removed from the interior of said blade, preferably by a wet etching process, and in a fourth step the insert is inserted into said blade channel.

According to an embodiment, in a fifth step the insert is fixed to the blade, especially by brazing.

Yet another aspect includes a gas turbine that comprises a rotor with a plurality of blades, which are mounted to a rotor shaft and are supplied with cooling air through said rotor shaft, whereby the blades are blades as described herein.

BRIEF DESCRIPTION OF THE DRAWINGS

The present invention is now to be explained more closely by means of different embodiments and with reference to the attached drawings.

DETAILED DESCRIPTION OF EXEMPLARY EMBODIMENTS

Figure 4:
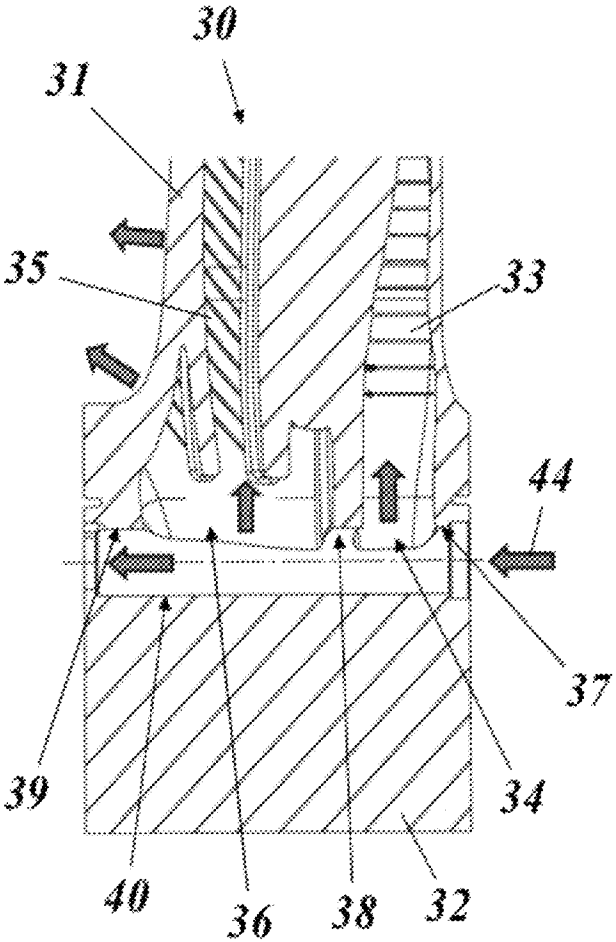
FIG. 4 shows a blade according to an embodiment of the invention with its blade channel, but without an insert.

In general terms, blades described herein include a (preferably tubular) insert in a horizontal blade channel for configuring and determining cooling air supply. An embodiment of this design is demonstrated in FIG. 4.

According to this embodiment, a blade 30 with an airfoil 31 and a blade root 32 is provided with cooling channels 33 and 35 running along a longitudinal direction of the blade 30 through the interior of the airfoil 31. The cooling channels 33, 35 open at their lower ends into respective cavities 34 and 36, which are separated from each other by a wall 38 and from the outside by walls 37 and 39. A cylindrical blade channel 40 runs transversely through the blade root 32, thereby connecting the cavities 34 and 36 and allowing broad access to all of the cooling channels 33, 35.

Figure 1:
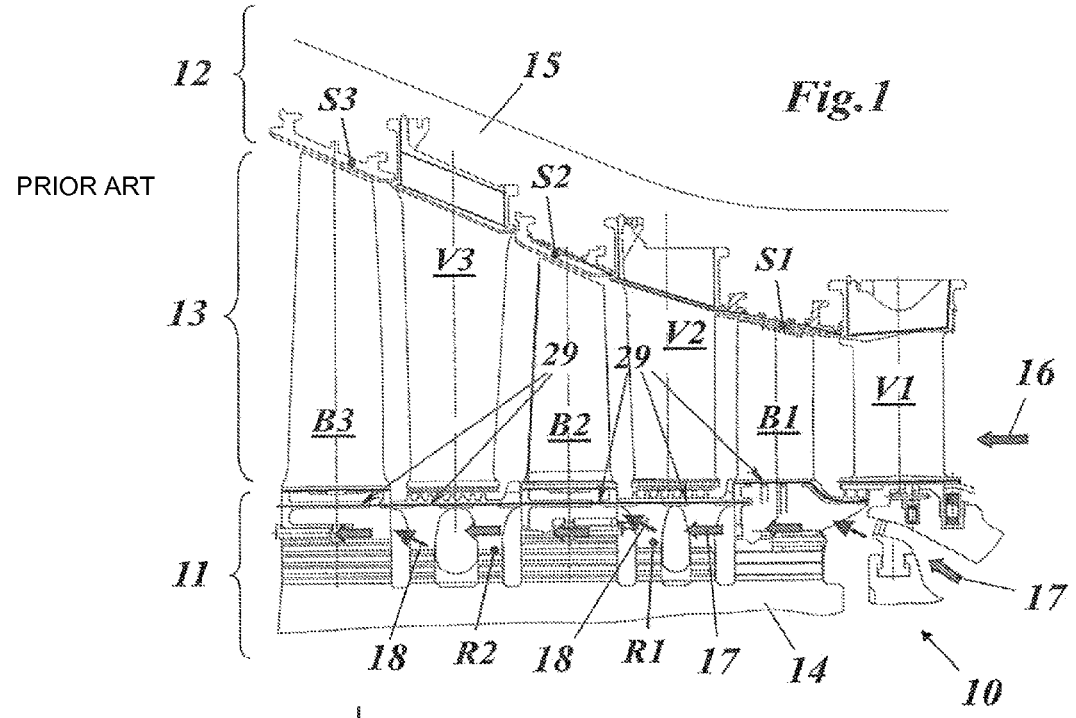
Fig.1 PRIOR ART
FIG. 1 shows a schematized section of a gas turbine stage, which can be used to realize the invention.
Figure 2:
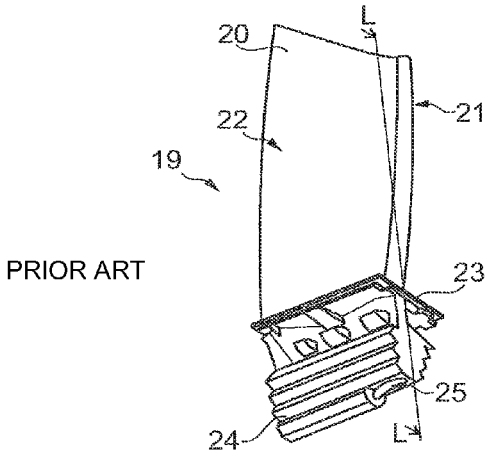
Fig. 2 PRIOR ART
FIG. 2 shows the external configuration of a typical gas turbine blade according to the state of the art.
Figure 3:
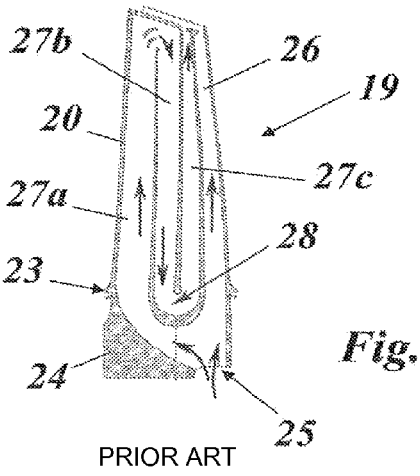
Fig.3 PRIOR ART
FIG. 3 shows the internal channel geometry of a typical gas turbine blade according to FIG. 2.
Figure 5:
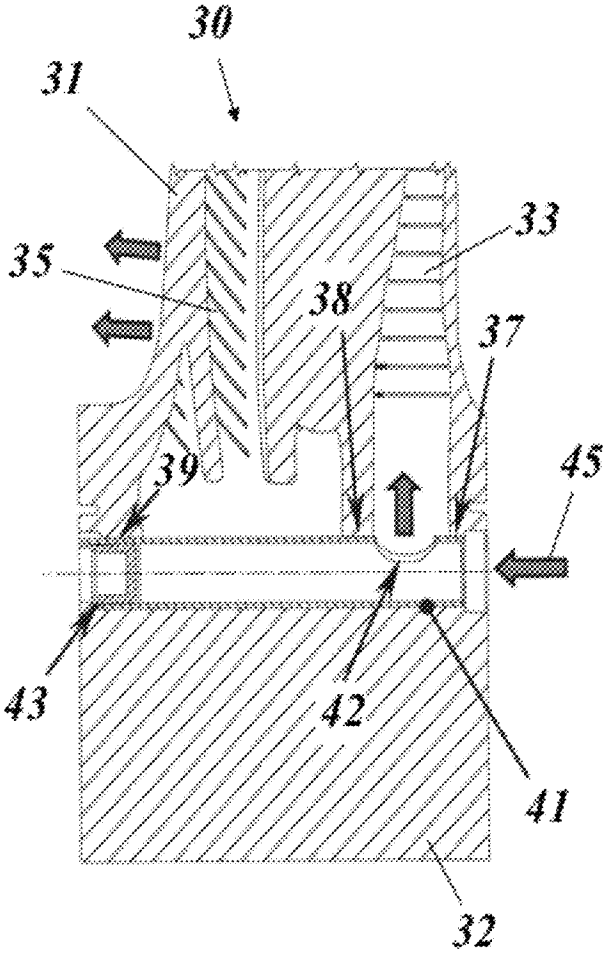
FIG. 5 shows the blade of FIG. 4 with an insert put into the blade channel.

As can be seen in FIG. 5, a tubular insert 41, which fits exactly into the cylindrical blade channel 40, is inserted into blade channel 40. The insert 41 receives at its one end a cooling air flow 45 and directs it into cooling channel 33 by a nozzle or opening 42 provided in its wall. At the other end of the insert 41, a suitable plug 43 closes the insert 41 such that all of cooling air entering the insert 41 flows into the one cooling channel 33. The other cooling channels (35 in this case) thus receive their cooling air via the cooling channel 33.

Figure 6:
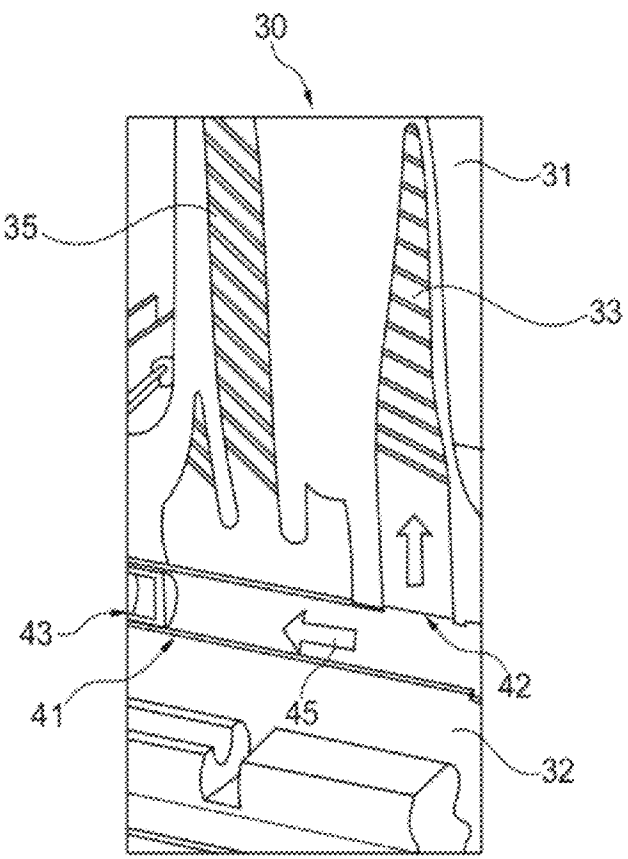
FIG. 6 shows the blade of FIG. 5 in a perspective view.

A basic advantage of the design stems from the tubular insert 41 with its vertical nozzle 42 (see FIG. 5) installed in the cylindrical blade channel 40. Prior to installation of the insert 41, cavities 34 and 36 are opened for access in a technological process including the etching-off of the ceramic core, which has been used for casting the blade; in this case, a flow-through of an etching liquid (liquid flow 44) is ensured to be performed freely in any direction (see FIG. 4). After etching out the ceramic core, the tubular insert 41 is installed, thereby separating cavities 34 and 36 at the wall 38, since it is not permissible for cavities 34 and 36 to be joined during blade operation within the gas turbine unit (see FIGS. 5, 6).

An advantageous feature is the cylindrical shape chosen for the insert, because in this case a minimum gap between the insert 41 and walls 37, 38 and 39 separating the cavities 34, 36 and the outside can be achieved in the simplest way due to machining matching surfaces of both blade 30 and insert 41 with high accuracy.

Figure 8:
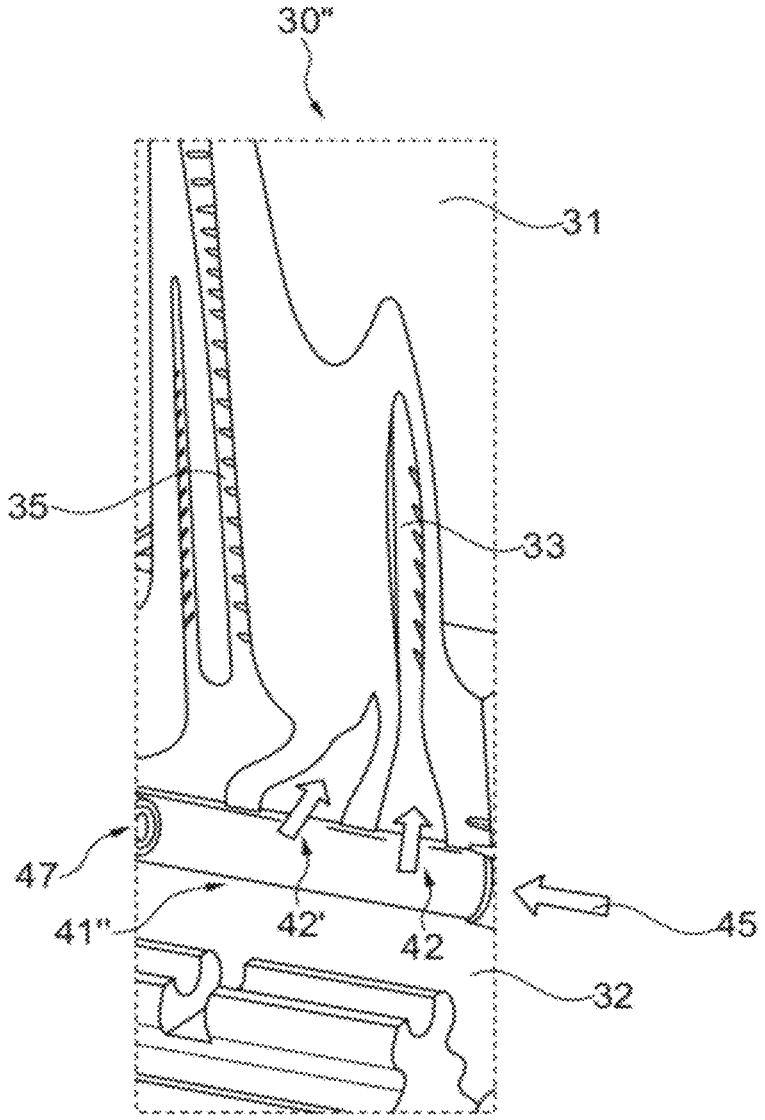
FIG. 8 shows in a perspective view another embodiment of the inventive blade with an insert, which is open at both ends.

Another, important feature of the proposed insert 41 is the possibility for adjusting the flow-through area of the nozzle 42. The nozzle 42 is used to supply a required amount of cooling air into the blade cavity 34 and cooling channel 33, respectively. If more than one cooling channel is necessary to supply air into the blade 30, then, in accordance with FIG. 8, an insert 41" can be provided in blade 30" with several nozzles 42 and 42'.

Figure 7:
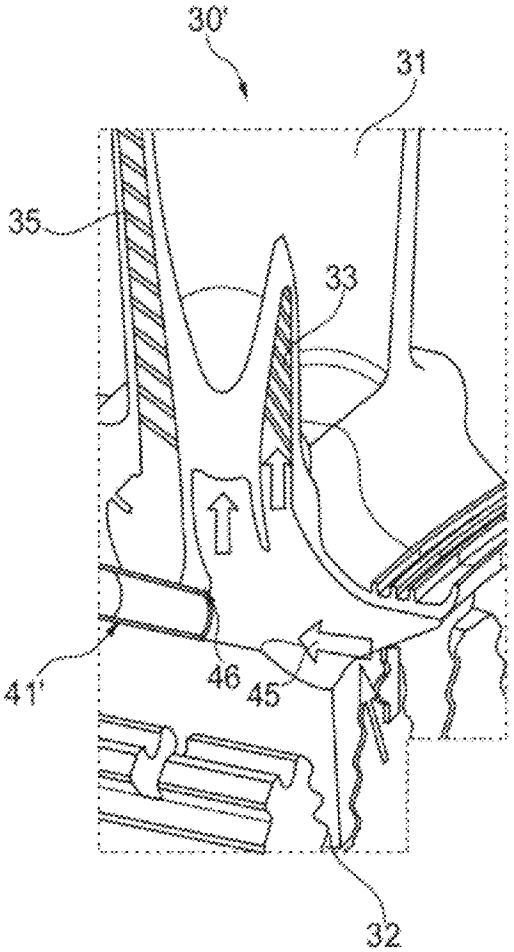
FIG. 7 shows another embodiment of the inventive blade with a different insert in a perspective view.

The outlet of the insert 41 can be provided with a plug 43 (see FIG. 5 or 6) or a nozzle 47 (see insert 41" in blade 30" in FIG. 8) depending on the rotor cooling scheme. The insert can also be used for mere separation of internal blade cavities without an additional nozzle (hole), which ensures cooling air supply into vertical blade channels (see FIG. 7, insert 41' in blade 30').

The insert 41, 41' or 41" should preferably be brazed to the blade 30, 30' or 30" to avoid any displacement, since, if the former was cranked or displaced, air supplying nozzles 42 or 42' could be partially closed or shut off.

Advantages of the proposed design include:

1. Cooling air overflows between internal blade channels are precluded. This improves blade cooling stability and reliability sufficiently (due to precise machining of matched part surfaces).
2. Cooling air leakages from the blade supply channel into the turbine flow path are eliminated (due to precise machining of matched part surfaces).
3. When required, nozzle flow-through area at the internal blade channel inlet (nozzle 42, 42', 42") can be adjusted easily by insert modification or change (see FIGS. 6, 7, 8).
4. When required, nozzle flow-through area at the insert inlet or outlet (nozzle 47) can be adjusted easily by insert change or nozzle change (see FIGS. 6, 8).
5. The cooling channel configuration can be optimized independent of the process requirements with respect to removal of the casting core.

In summary, a blade with cylindrical tubular insert and vertical holes in the blade allows cooling air leaks to be reduced, blade reliability and life time to be increased, and turbine efficiency to be improved.

LIST OF REFERENCE NUMERALS

10 gas turbine
11 rotor
12 stator
13 hot gas path
14 rotor shaft
15 vane carrier
16 hot gas
17 cooling air (main flow)
18 cooling air (entering blades)
19,B1-B3 blade
20 airfoil
21 leading edge
22 trailing edge
23 platform
24 blade root
25 inlet
26 cooling channel
27*a-c* cooling channel

28 dead end zone
29 sealing plate
30,30',30" blade
31 airfoil
32 blade root
33,35 cooling channel
34,36 cavity
37,38,39,46 wall
40 blade channel (cylindrical)
41,41',41" insert (tubular)
42,42',47 nozzle (opening)
43 plug
44 liquid flow
45 cooling air flow
R1,R2 rotor heat shield
S1-S3 stator heat shield
V1-V3 vane While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A blade for a gas turbine having a rotor shaft, the blade comprising:

an airfoil extending along a longitudinal direction, and a blade root configured and arranged to mount said blade on the rotor shaft, wherein said blade root includes a cooling air supply arranged within said blade root and said airfoil comprises interior cooling channels, which cooling channels extend along the longitudinal direction and can be supplied with cooling air through the blade root cooling air supply;

wherein said blade root comprises a blade channel running transversely through said blade root and being connected to said cooling channels, and an insert positioned in said blade channel and including fluid connections between said blade channel and said cooling channels;

wherein the blade channel comprises a cylindrical channel, and the insert is of a tubular configuration such that the insert fits exactly into said cylindrical channel;

wherein the insert comprises a wall and at least one nozzle in said wall, through which at least one nozzle of said cooling channels is connected to said blade channel, and which at least one nozzle determines a mass flow of cooling air entering said one cooling channel;

wherein said insert is configured and arranged for cooling air to be supplied to said insert at one end of said insert; and wherein said insert is configured and arranged for cooling air to exit said insert at an opposite end of said insert.

2. A blade according to claim 1, comprising:

a wall separating two adjacent cooling channels, said two adjacent cooling channels being fluidly connected via said blade channel, and said insert is configured and arranged to close said connection between said adjacent cooling channels.

3. A blade according to claim 1, wherein said insert is brazed to said blade.

4. A blade according to claim 1, wherein said insert includes a nozzle at said opposite end of said insert through which said cooling air can exit.

5. A blade for a gas turbine having a rotor shaft, the blade comprising:

an airfoil extending along a longitudinal direction, and a blade root configured and arranged to mount said blade on the rotor shaft, wherein said blade root includes a cooling air supply arranged within said blade root and said airfoil comprises interior cooling channels, which cooling channels extend along the longitudinal direction and can be supplied with cooling air through the blade root cooling air supply;

wherein said blade root comprises a blade channel running transversely through said blade root and being connected to said cooling channels, and an insert positioned in said blade channel and including fluid connections between said blade channel and said cooling channels;

wherein the blade channel comprises a cylindrical channel, and the insert is of a tubular configuration such that the insert fits exactly into said cylindrical channel;

wherein the insert comprises a wall and at least one nozzle in said wall, through which at least one nozzle of said cooling channels is connected to said blade channel, and which at least one nozzle determines a mass flow of cooling air entering said one cooling channel; and wherein said insert is configured and arranged for cooling air to exit said insert at an opposite end of said insert.

6. A blade according to claim 5, wherein said insert includes a nozzle at said opposite end of said insert through which said cooling air can exit.

7. A blade according to claim 5, comprising:

a wall separating two adjacent cooling channels, said two adjacent cooling channels being fluidly connected via said blade channel, and said insert is configured and arranged to close said connection between said adjacent cooling channels.

8. A blade according to claim 5, wherein said insert is brazed to said blade.

9. A gas turbine comprising:

a rotor with a shaft and plurality of blades mounted to the rotor shaft, the rotor shaft including a cooling air supply configured and arranged to supply cooling air through said rotor shaft to said blades; and wherein said blades comprise an airfoil extending along a longitudinal direction, and a blade root configured and arranged to mount said blade on the rotor shaft, wherein said blade root includes a cooling air supply arranged within said blade root and said airfoil comprises interior cooling channels, which cooling channels extend along the longitudinal direction and can be supplied with cooling air through the blade root cooling air supply;

wherein said blade root comprises a blade channel running transversely through said blade root and being connected to said cooling channels, and an insert positioned in said blade channel and including fluid connections between said blade channel and said cooling channels;

wherein the blade channel comprises a cylindrical channel, and the insert is of a tubular configuration such that the insert fits exactly into said cylindrical channel;

wherein the insert comprises a wall and at least one nozzle in said wall, through which at least one nozzle of said cooling channels is connected to said blade channel, and which at least one nozzle determines a mass flow of cooling air entering said one cooling channel;

wherein said insert is configured and arranged for cooling air to be supplied to said insert at one end of said insert; and wherein said insert is configured and arranged for cooling air to exit said insert at an opposite end of said insert.

* * * * *